US011289854B2

(12) United States Patent
Hsueh et al.

(10) Patent No.: US 11,289,854 B2
(45) Date of Patent: Mar. 29, 2022

(54) ELECTRICAL CONNECTING DEVICE

(71) Applicant: SPEED TECH CORPORATION, Taoyuan (TW)

(72) Inventors: Cheng-Hsiang Hsueh, Taoyuan (TW); I-Ting Hsieh, Taoyuan (TW); Chih-Cheng Chen, Taoyuan (TW)

(73) Assignee: SPEED TECH CORPORATION, Taoyuan (TW)

( * ) Notice: Subject to any disclaimer, the term of this patent is extended or adjusted under 35 U.S.C. 154(b) by 10 days.

(21) Appl. No.: 16/932,918

(22) Filed: Jul. 20, 2020

(65) Prior Publication Data

US 2020/0350732 A1 Nov. 5, 2020

(30) Foreign Application Priority Data

Jul. 29, 2019 (TW) ..... 108209949

(51) Int. Cl.

| | |
|---|---|
| ***H01R 4/66*** | (2006.01) |
| ***H01R 13/6471*** | (2011.01) |
| ***H01R 13/6585*** | (2011.01) |
| ***H01R 13/6583*** | (2011.01) |
| ***H01R 12/72*** | (2011.01) |
| ***H01R 24/60*** | (2011.01) |
| ***H01R 13/40*** | (2006.01) |
| *H01R 107/00* | (2006.01) |

(52) U.S. Cl.

CPC ..... *H01R 13/6471* (2013.01); *H01R 12/724* (2013.01); *H01R 13/40* (2013.01); *H01R 13/6583* (2013.01); *H01R 13/6585* (2013.01); *H01R 24/60* (2013.01); *H01R 2107/00* (2013.01)

(58) Field of Classification Search

CPC .. H01R 12/724; H01R 13/40; H01R 13/6471; H01R 13/6583; H01R 13/6585; H01R 24/60; H01R 2107/00

USPC ..... 439/79, 108

See application file for complete search history.

(56) References Cited

U.S. PATENT DOCUMENTS

| | | | | |
|---|---|---|---|---|
| 9,634,437 | B2 * | 4/2017 | Kao | H01R 13/6471 |
| 2014/0024257 | A1 * | 1/2014 | Castillo | H01R 13/6585 439/607.05 |
| 2019/0089077 | A1 * | 3/2019 | Huang | H01R 13/405 |

FOREIGN PATENT DOCUMENTS

| | | |
|---|---|---|
| TW | M546036 U | 7/2017 |

* cited by examiner

*Primary Examiner* — Khiem M Nguyen

(74) *Attorney, Agent, or Firm* — Birch, Stewart, Kolasch & Birch, LLP

(57) ABSTRACT

An electrical connecting device includes an insulated body, a first terminal set, and a conductive shielding member. The insulated body includes a base and a tongue plate connected to the base. The first terminal set includes several first signal terminals and several first ground terminals. Each of the first signal terminals and the first ground terminals includes a fixed portion and a contact portion. The fixed portion of each of the first signal terminals and the fixed portion of each of the first ground terminals is in the base, and the contact portion of each of the first signal terminals and the contact portion of each of the first ground terminals are extending to the tongue plate and exposed from the tongue plate. The conductive shielding member is in the insulated body, and the conductive shielding member is near but not in contact with the first terminal set.

9 Claims, 6 Drawing Sheets

ELECTRICAL CONNECTING DEVICE

CROSS-REFERENCE TO RELATED APPLICATION

This non-provisional application claims priority under 35 U.S.C. § 119(a) to Patent Application No. 108209949 filed in Taiwan, R.O.C. on Jul. 29, 2019, the entire contents of which are hereby incorporated by reference.

BACKGROUND

Technical Field

The instant disclosure relates to a connecting device, in particular, to an electrical connecting device.

Related Art

Data can be transmitted between existing electronic devices via electrical connectors. An electrical connector assembly known to the inventor(s) has a male connector and a female connector. The male connector and the female connector respectively have bodies and several terminals arranged on the bodies. When the male connector is connected to the female connector, terminals on the male connector and terminals on the female connector are in contact with each other for signal transmission. However, for satisfying the nowadays electronic devices with high computational capabilities and high data storage capabilities, the electrical connectors not only have to transmit huge amount of data but also have to transmit the data with much faster transmission speeds. However, to meet such requirements, the numbers of the electrical connector, the terminal density, and the operating frequency of the electrical connector have to be increased, thereby resulting interferences during signal transmission.

SUMMARY

In view of this, an electrical connecting device is provided for improving the transmission interference issue.

In one embodiment, an electrical connecting device comprises an insulated body, a first terminal set, and a conductive shielding member. The insulated body comprises a base and a tongue plate, and the tongue plate is connected to the base. The first terminal set comprises a plurality of first signal terminals and a plurality of first ground terminals. Each of the first signal terminals and each of the first ground terminals respectively comprise a fixed portion and a contact portion, the fixed portion of each of the first signal terminals and the fixed portion of each of the first ground terminals are in the base, and the contact portion of each of the first signal terminals and the contact portion of each of the first ground terminals are extending to the tongue plate and exposed from the tongue plate. The conductive shielding member is in the insulated body, and the conductive shielding member is near but not in contact with the first terminal set.

As above, the conductive shielding member of the electrical connecting device according to one or some embodiments of the instant disclosure can achieve a proper noise shielding performance without being in contact with the ground terminals. Hence, interference during transmission can be effectively prevented, thereby ensuring the quality in signal transmission.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
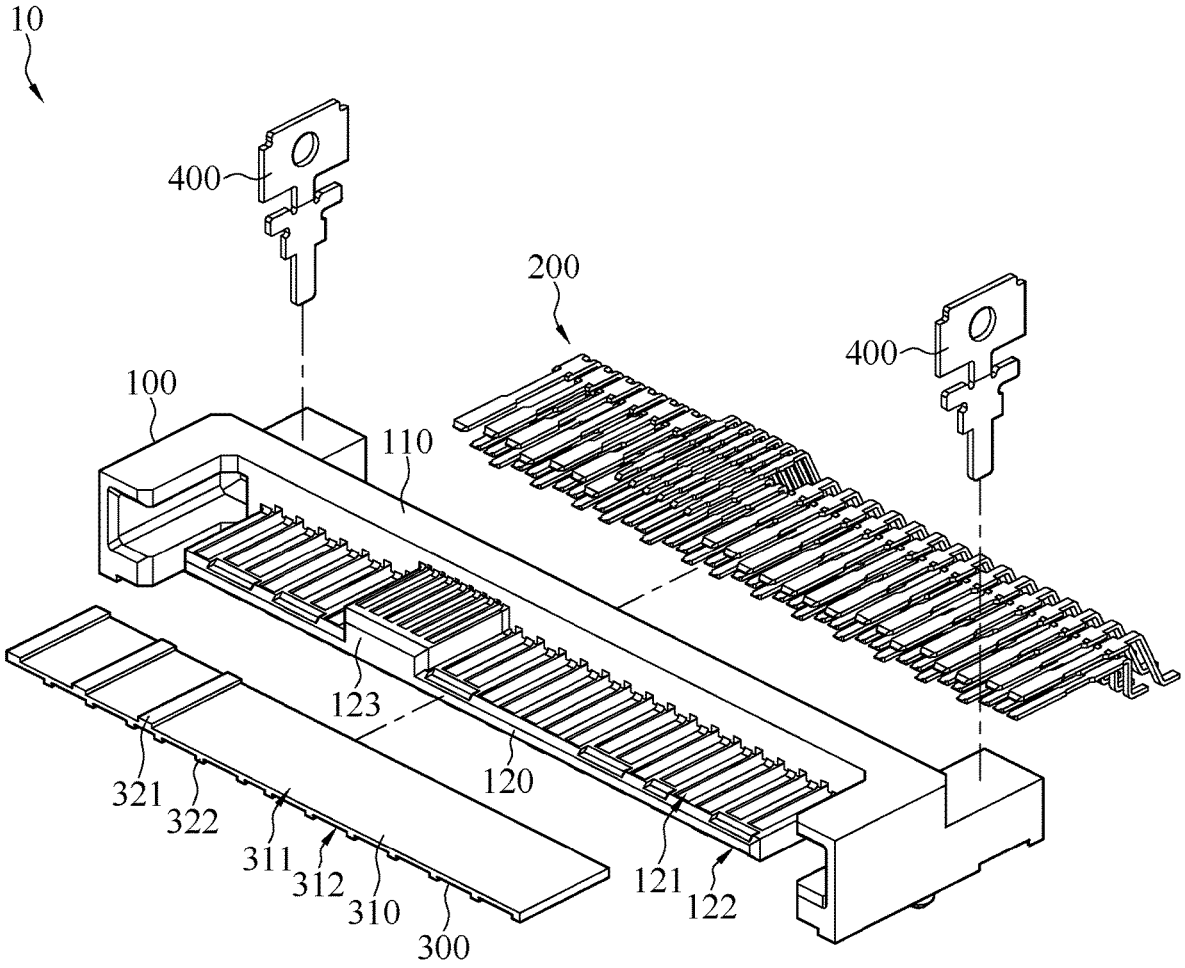
FIG. 1 illustrates an exploded view of an electrical connecting device according to an exemplary embodiment of the instant disclosure.
Figure 2:
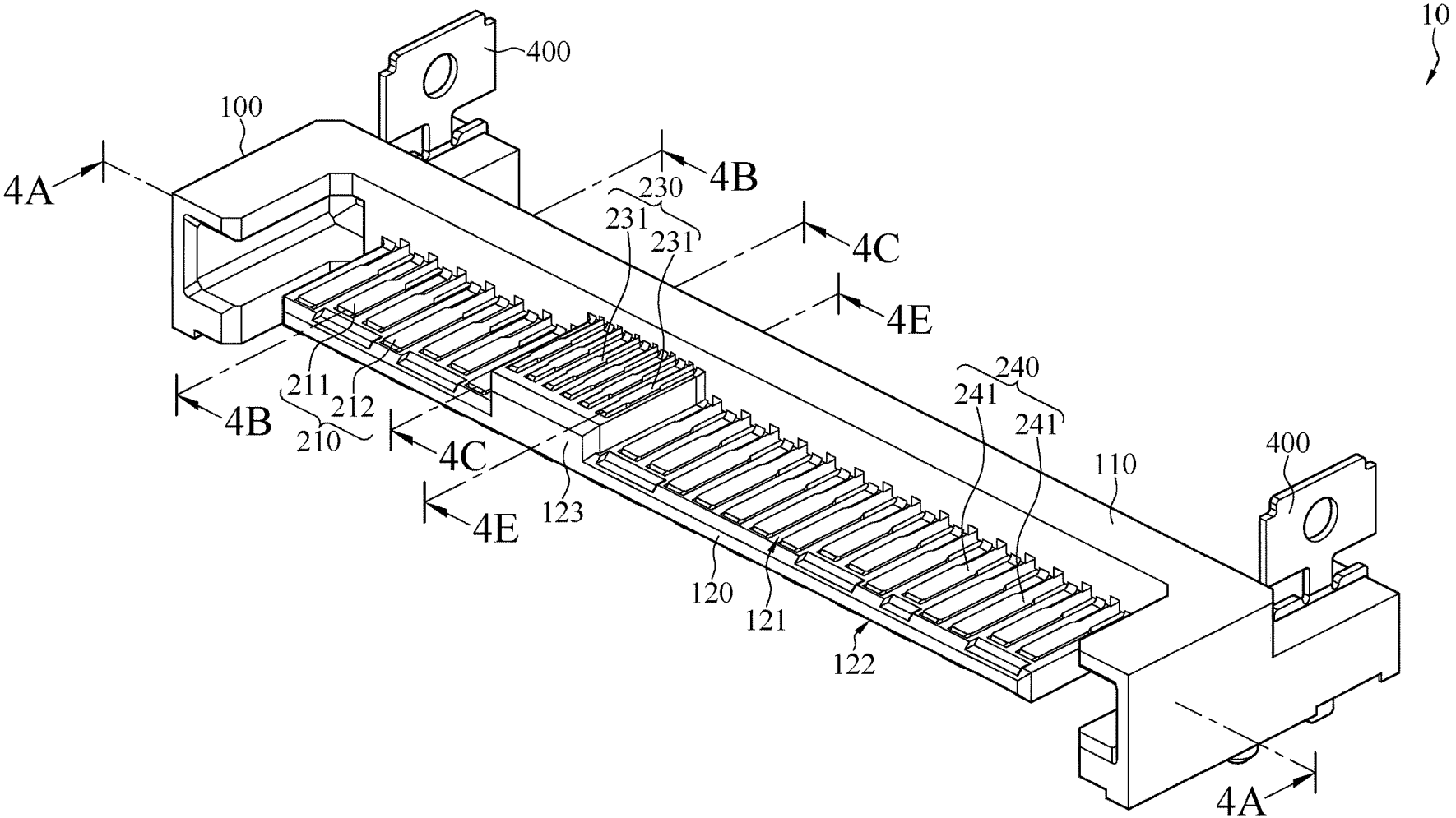
FIG. 2 illustrates a schematic perspective view of the electrical connecting device of the exemplary embodiment.

Please refer to FIGS. 1 and 2. FIG. 1 illustrates an exploded view of an electrical connecting device according to an exemplary embodiment of the instant disclosure. FIG. 2 illustrates a schematic perspective view of the electrical connecting device of the exemplary embodiment. In this embodiment, the electrical connecting device 10 is a male connector, but embodiments are not limited thereto. The electrical connecting device 10 comprises an insulating body 100, a terminal assembly 200, and a conductive shielding member 300. The insulating body 100 comprises a base 110 and a tongue plate 120, and the tongue plate 120 is connected to the base 110. The tongue plate 120 is extending toward the direction away from the base 110. The insulating body 100 is made of insulation materials, the insulation materials may be, but not limited to, plastics. As shown in FIG. 2, in this embodiment, the terminal assembly 200 comprises a first terminal set 210. The first terminal set 210 comprises a plurality of first signal terminals 211 and a plurality of first ground terminals 212, and the first signal terminals 211 and the first ground terminals 212 are arranged on the tongue plate 120 in a predefined order and are in the base 110.

Figure 3:
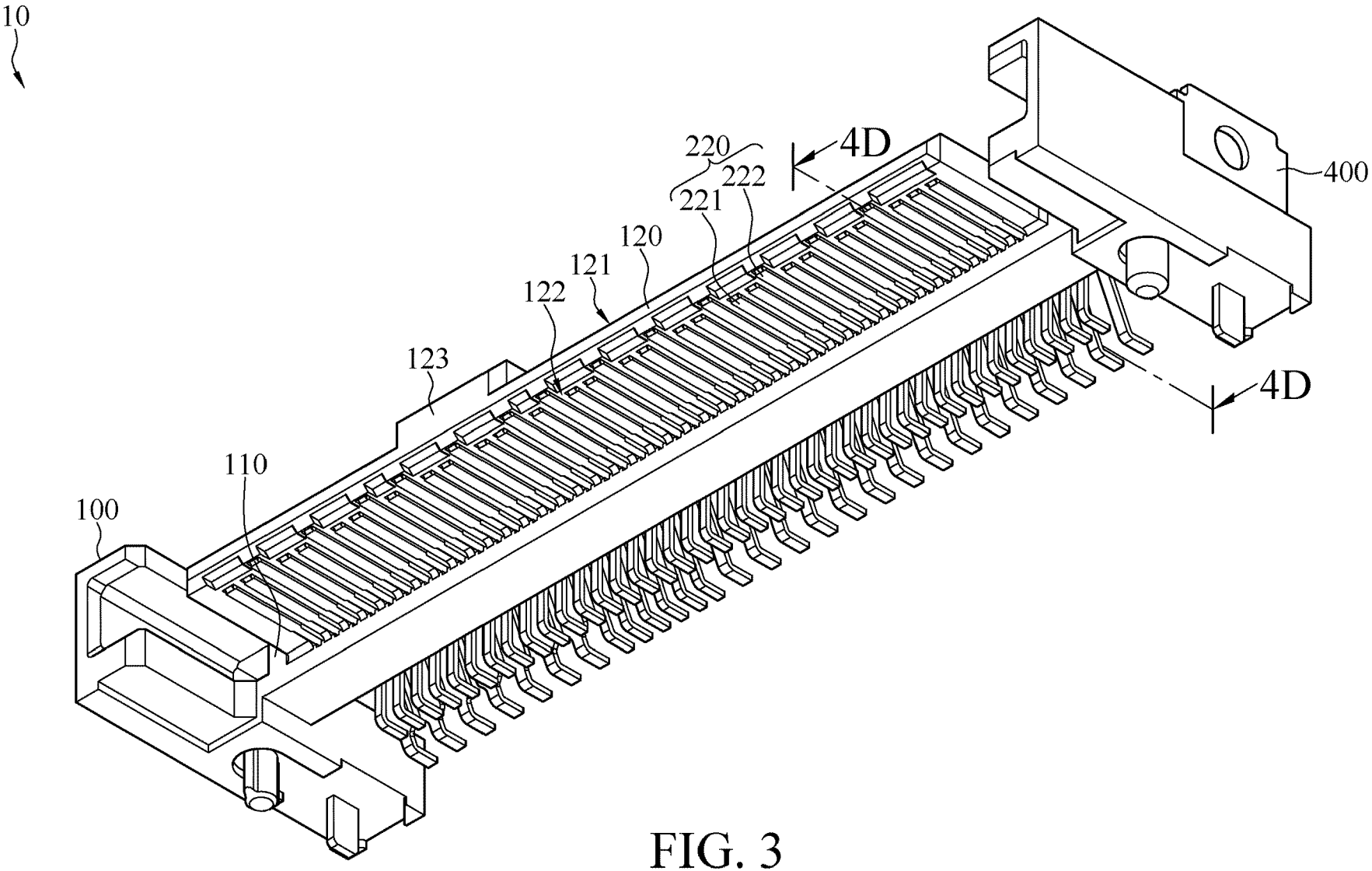
FIG. 3 illustrates another schematic perspective view of the electrical connecting device shown in FIG. 2.

Please refer to FIG. 3. FIG. 3 illustrates another schematic perspective view of the electrical connecting device 10 shown in FIG. 2. As shown in FIGS. 1 to 3, in this embodiment, the tongue plate 120 has a first surface 121 and a second surface 122 opposite to the first surface 121, and the first signal terminals 211 and the first ground terminals 212 are configured on the first surface 121 of the tongue plate 120. Moreover, in this embodiment, the conductive shielding member 300 is in the insulated body 100. Furthermore, the conductive shielding member 300 is near the first terminal set 210 but not in contact with the first terminal set 210; detail descriptions are provided in the following paragraphs.

As shown in FIGS. 1 to 3, in this embodiment, the electrical connecting device 10 further comprises a pair of fixing elements 400 respectively fixed at opposite ends of the base 110, and the electrical connecting device 10 can be stably fixed on a corresponding circuit board (not shown) via the fixing elements 400.

Figure 4A:
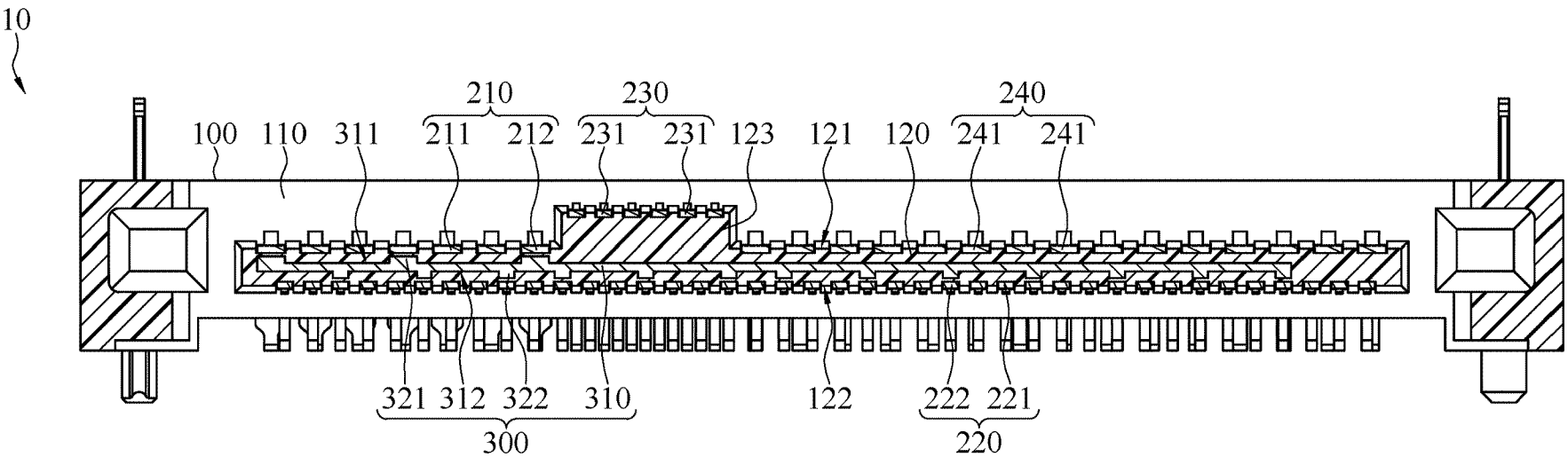
FIG. 4A illustrates a cross-sectional view along line 4A-4A shown in FIG. 2.
Figure 4B:
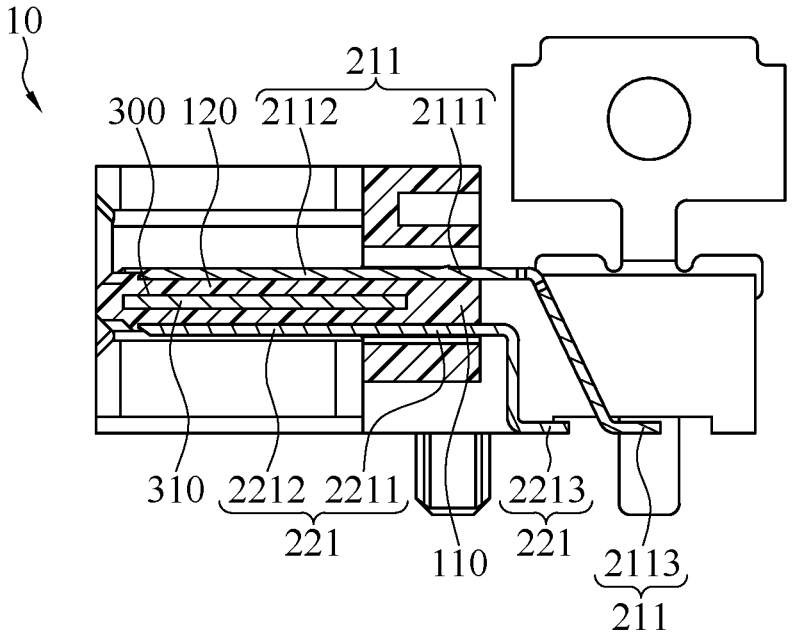
FIG. 4B illustrates a cross-sectional view along line 4B-4B shown in FIG. 2.

Please refer to FIGS. 4A and 4B. FIG. 4A illustrates a cross-sectional view along line 4A-4A shown in FIG. 2. FIG. 4B illustrates a cross-sectional view along line 4B-4B shown in FIG. 2. As shown in FIGS. 1 and 4A, in this embodiment, the conductive shielding member 300 comprises a plate body 310. The plate body 310 is in the tongue plate 120. In some embodiments, the plate body 310 may be further extending, from the tongue plate 120, to the inside of the base 110. In this embodiment, the conductive shielding member 300 is a one-piece structure, and the conductive shielding member 300 is made of conductive plastics, but embodiments are not limited thereto. As shown in FIG. 2 to FIG. 4B, in this embodiment, the insulated body 100 completely encloses the conductive shielding member 300, and the conductive shielding member 300 is not exposed from the insulated body 100. As shown in FIGS. 4A and 4B, in this embodiment, the conductive shielding member 300 and the first terminal set 210 are separated by the insulated body 100, and the insulated body 100 is adapted to fill the gap between the conductive shielding member 300 and the first terminal set 210.

As shown in FIG. 4B, in this embodiment, each of the first signal terminals 211 of the first terminal set 210 comprises a fixed portion 2111, a contact portion 2112, and a connection portion 2113, and the fixed portion 2111 is connected between the contact portion 2112 and the connection portion 2113. The fixed portion 2111 of each of the first signal terminals 211 is in the base 110, and the fixed portion 2111 of each of the first signal terminals 211 is engaged in the base 110 with an interference mechanism, but embodiments are not limited thereto. The contact portion 2112 of each of the first signal terminals 211 is extending, from the base 110, to the first surface 121 of the tongue plate 120, and the contact portion 2112 of each of the first signal terminals 211 is exposed from the first surface 121 of the tongue plate 120. Specifically, in this embodiment, the contact portion 2112 of each of the first signal terminals 211 is adapted to be in contact with the contact portion of the corresponding terminal of a mating electrical connecting device. The connection portion 2113 of each of the first signal terminals 211 is extending, from the base 110, to the direction away from the tongue plate 120, and the connection portions 2113 of the first signal terminals 211 are provided for being soldered on a corresponding circuit board. Moreover, as shown in FIGS. 4A and 4B, in this embodiment, the plate body 310 is not in contact with the contact portion 2112 of each of the first signal terminals 211.

Figure 4C:
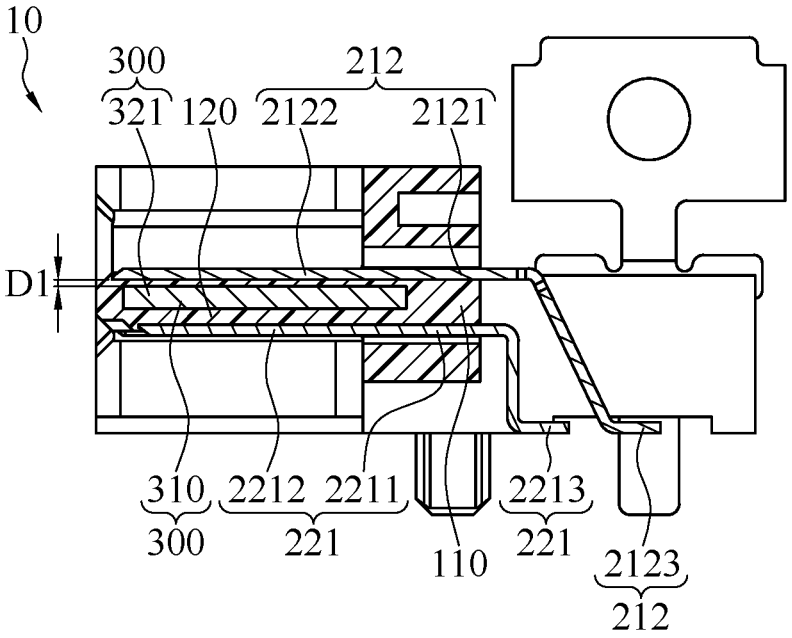
FIG. 4C illustrates a cross-sectional view along line 4C-4C shown in FIG. 2.

Please refer to FIG. 4C. FIG. 4C illustrates a cross-sectional view along line 4C-4C shown in FIG. 2. As shown in FIG. 4C, in this embodiment, each of the first ground terminals 212 comprises a fixed portion 2121, a contact portion 2122, and a connection portion 2123, and the fixed portion 2121 is connected between the contact portion 2122 and the connection portion 2123. The fixed portion 2121 of each of the first ground terminals 212 may be, but not limited to, engaged in the base 110 with an interference mechanism. The contact portion 2122 of each of the first ground terminals 212 is extending, from the base 110, to the first surface 121 of the tongue plate 120, and the contact portion 2122 of each of the first ground terminals 212 is exposed from the first surface 121 of the tongue plate 120. The connection portion 2123 of each of the first ground terminals 212 is extending, from the base 110, to the direction away from the tongue plate 120, and the connection portions 2123 are provided for being soldered on a corresponding circuit board.

As shown in FIGS. 1, 4A, and 4C, in this embodiment, the conductive shielding member 300 further comprises a plurality of ribs 321. The plate body 310 has a first side 311 and a second side 312 opposite to the first side 311. The ribs 321 are protruding from the first side 311 of the plate body 310, and the ribs 321 are configured for corresponding to the first ground terminals 212, respectively. As shown in FIG. 4A, in this embodiment, the number of the ribs 321 is three, but embodiments are not limited thereto. As shown in FIGS. 4A and 4C, in this embodiment, the three ribs 321 are respectively aligned with the three contact portions 2122 of the three first ground terminals 212. Moreover, a distance D1 between each of the ribs 321 and the contact portion 2122 of the corresponding first ground terminal 212 is less than a distance between the plate body 310 and the contact portion 2112 of the corresponding first signal terminal 211 (as shown in FIG. 4B), and the distance D1 between each of the ribs 321 and the contact portion 2122 of the corresponding first ground terminal 212 is in the range between 0.03 mm to 0.3 mm. In some embodiments, the distance D1 between each of the ribs 321 and the contact portion 2122 of the corresponding first ground terminal 212 is in the range between 0.05 mm to 0.3 mm.

As shown in FIGS. 3 and 4A, in this embodiment, the terminal assembly 200 of the electrical connecting device 10 further comprises a second terminal set 220. The second terminal set 220 comprises a plurality of second signal terminals 221 and a plurality of second ground terminals 222, and the second signal terminals 221 and the second ground terminals 222 are arranged on the tongue plate 120 in a predefined order and held in the base 110. Moreover, the second signal terminals 221 and the second ground terminals 222 are configured on the second surface 122 of the tongue plate 120. Moreover, the conductive shielding member 300 is near the second terminal set 220 but not in contact with the second terminal set 220.

As shown in FIG. 4A, in this embodiment, when considering parts of the first terminal set 210 and the second terminal set 220 on the tongue plate 120, the conductive shielding member 300 is between the first terminal set 210 and the second terminal set 220.

As shown in FIGS. 4A and 4B, in this embodiment, each of the second signal terminals 221 of the second terminal set 220 comprises a fixed portion 2211, a contact portion 2212, and a connection portion 2213, and the fixed portion 2211 is connected between the contact portion 2212 and the connection portion 2213. The fixed portion 2211 of each of the second signal terminals 221 may be, but not limited to, engaged in the base 110 with an interference mechanism. The contact portion 2212 of each of the second signal terminals 221 is extending, from the base 110, to the second surface 122 of the tongue plate 120, and the contact portion 2212 of each of the second signal terminals 221 is exposed from the second surface 122 of the tongue plate 120. Specifically, in this embodiment, the contact portion 2212 of each of the second signal terminals 221 is adapted to be in contact with the contact portion of the corresponding terminal of a mating electrical connecting device. The connection portion 2213 of each of the second signal terminals 221 is extending, from the base 110, to the direction away from the tongue plate 120, and the connection portions 2213 are provided for being soldered on a corresponding circuit board. Moreover, as shown in FIGS. 4A and 4B, in this embodiment, the plate body 310 is not in contact with the contact portion 2212 of each of the second signal terminals 221.

Figure 4D:
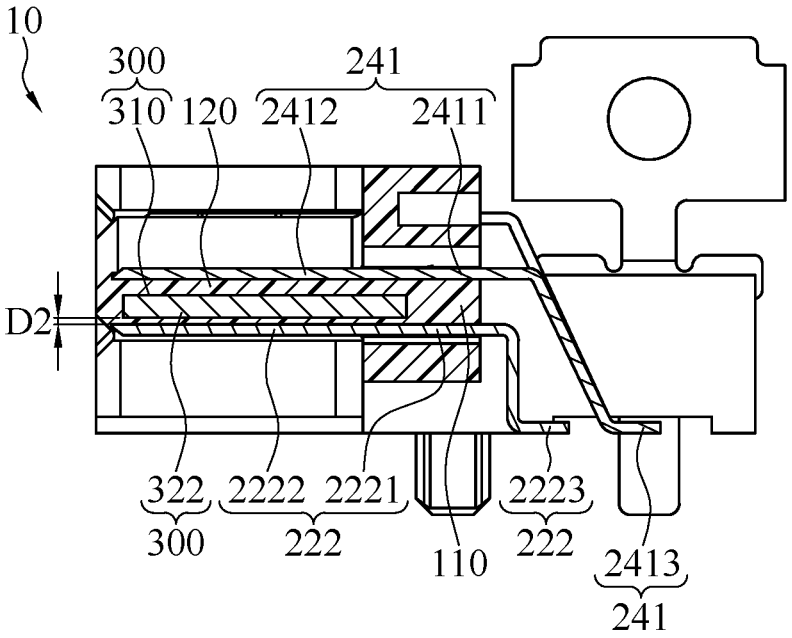
FIG. 4D illustrates a cross-sectional view along line 4D-4D shown in FIG. 2.

Please refer to FIG. 4D. FIG. 4D illustrates a cross-sectional view along line 4D-4D shown in FIG. 2. As shown in FIG. 4D, in this embodiment, each of the second ground terminals 222 comprises a fixed portion 2221, a contact portion 2222, and a connection portion 2223, and the fixed portion 2221 is connected between the contact portion 2222 and the connection portion 2223. The fixed portion 2221 of each of the second ground terminals 222 may be, but not limited to, engaged in the base 110 with an interference mechanism. The contact portion 2222 of each of the second ground terminals 222 is extending, from the base 110, to the second surface 122 of the tongue plate 120, and the contact portion 2222 of each of the second ground terminals 222 is exposed from the second surface 122 of the tongue plate 120. The connection portion 2223 of each of the second ground terminals 222 is extending, from the base 110, to the direction away from the tongue plate 120, and the connection portions 2223 are provided for being soldered on a corresponding circuit board.

As shown in FIGS. 4A to 4D, in this embodiment, the conductive shielding member 300 is between the contact portions 2112, 2122 of the first signal terminals 211 and the first ground terminals 212 and the contact portions 2212, 2222 of the second signal terminals 221 and the second ground terminals 222.

As shown in FIGS. 1, 4A, and 4D, in this embodiment, the conductive shielding member 300 further comprises a plurality of ribs 322. The ribs 322 are protruding from the second side 312 of the plate body 310, and the ribs 322 are configured for corresponding to the second ground terminals 222, respectively. As shown in FIG. 4A, in this embodiment, the number of the ribs 322 is thirteen, but embodiments are not limited thereto. As shown in FIGS. 4A and 4D, in this embodiment, the thirteen ribs 322 are respectively aligned with the thirteen contact portions 2222 of the thirteen second ground terminals 222. Moreover, a distance D2 between each of the ribs 322 and the contact portion 2222 of the corresponding second ground terminal 222 is less than the distance between the plate body 310 and the contact portion 2212 of the corresponding second signal terminal 221 (as shown in FIG. 4B), and the distance D2 between each of the ribs 322 and the contact portion 2222 of the corresponding second ground terminal 222 is in the range between 0.03 mm to 0.3 mm. In some embodiments, the distance D2 between each of the ribs 322 and the contact portion 2222 of the corresponding second ground terminal 222 is in the range between 0.05 mm to 0.3 mm.

As shown in FIGS. 2 and 4A, in this embodiment, the terminal assembly 200 of the electrical connecting device 10 further comprises a third terminal set 230 and a fourth terminal set 240. The third terminal set 230 comprises a plurality of terminals 231, and the fourth terminal set 240 comprises a plurality of terminals 241. The terminals 231 of the third terminal set 230 and the terminals 241 of the fourth terminal set 240 are configured on the first surface 121 of the tongue plate 120. The first terminal set 210, the third terminal set 230, and the fourth terminal set 240 are arranged on the first surface 121 of the tongue plate 120, and the third terminal set 230 is between the first terminal set 210 and the fourth terminal set 240. The conductive shielding member 300 is not in contact with the third terminal set 230 and the fourth terminal set 240.

As shown in FIG. 4A, in this embodiment, when considering parts of the first terminal set 210, the second terminal set 220, the third terminal set 230, and the fourth terminal set 240 on the tongue plate 120, the conductive shielding member 300 is between the first terminal set 210 and the second terminal set 220, between the third terminal set 230 and the second terminal set 220, and between the fourth terminal set 240 and the second terminal set 220. In this embodiment, the conductive shielding member 300 comprises ribs 321, 322 corresponding to the first ground terminals 212 of the first terminal set 210 and the second ground terminals 222 of the second terminal set 220. The ribs 321, 322 are near but not in contact with the first ground terminals 212 and the second ground terminals 222. That is, in this embodiment, to achieve a proper noise shielding performance, the conductive shielding member 300 just has to be near the ground terminals of the terminal sets but not need to be in contact with the ground terminals. In this embodiment, portions of the conductive shielding member 300 corresponding to the third terminal set 230 and the fourth terminal set 240 is devoid of ribs, so that the conductive shielding member 300 is devoid of ribs near the terminals 231 of the third terminal set 230 and near the terminals 241 of the fourth terminal set 240. In other words, in this embodiment, portions of the first side 311 of the conductive shielding member 300 near the third terminal set 230 and the fourth terminal set 240 are flat surfaces without ribs.

As shown in FIG. 4D, in this embodiment, each of the terminals 241 of the fourth terminal set 240 comprises a fixed portion 2411, a contact portion 2412, and a connection portion 2413, and the fixed portion 2411 is connected between the contact portion 2412 and the connection portion 2413. The fixed portion 2411 of each of the terminals 241 of the fourth terminal set 240 may be, but not limited to, engaged in the base 110 with an interference mechanism. The contact portion 2412 of each of the terminals 241 is extending, from the base 110, to the first surface 121 of the tongue plate 120, and the contact portion 2412 of each of the terminals 241 is exposed from the first surface 121 of the tongue plate 120. Specifically, in this embodiment, the contact portion 2412 of each of the terminals 241 is adapted to be in contact with the contact portion of the corresponding terminal of the mating electrical connecting device. The connection portion 2413 of each of the terminals 241 is extending, from the base 110, to the direction away from the tongue plate 120, and the connection portions 2413 are provided for being soldered on a corresponding circuit board. Moreover, as shown in FIGS. 4A and 4D, in this embodiment, the plate body 310 is not in contact with the contact portions 2412 of the terminals 241. The ribs 322 are protruding from the second side 312 of the plate body 310, and the ribs 322 are configured just for corresponding to the second ground terminals 222; namely, the conductive shielding member 300 is devoid of ribs near the terminals 241.

Figure 4E:
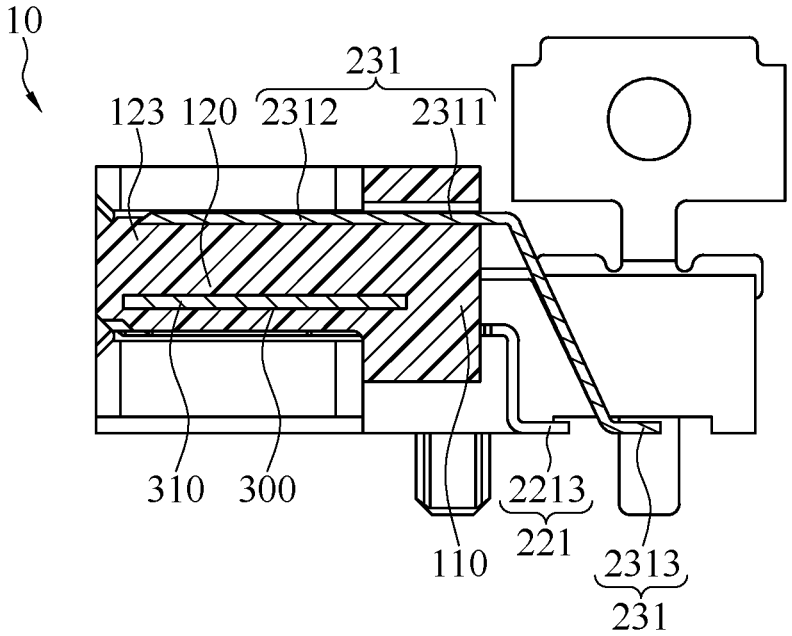
FIG. 4E illustrates a cross-sectional view along line 4E-4E shown in FIG. 2.

Please refer to FIG. 4E. FIG. 4E illustrates a cross-sectional view along line 4E-4E shown in FIG. 2. In this embodiment, each of the terminals 231 of the third terminal set 230 comprises a fixed portion 2311, a contact portion 2312, and a connection portion 2313, and the fixed portion 2311 is connected between the contact portion 2312 and the connection portion 2313. The fixed portion 2311 of each of the terminals 231 may be, but not limited to, engaged in the base 110 with an interference mechanism. The contact portion 2312 of each of the terminals 231 is extending, from the base 110, to the first surface 121 of the tongue plate 120, and the contact portion 2312 of each of the terminals 231 is exposed from the first surface 121 of the tongue plate 120. Specifically, in this embodiment, the contact portion 2312 of each of the terminals 231 is adapted to be in contact with the contact portion of the corresponding terminal of a mating electrical connecting device. The connection portion 2313 of each of the terminals 231 is extending, from the base 110, to the direction away from the tongue plate 120, and the connection portions 2313 are provided for being soldered on a corresponding circuit board. Moreover, as shown in FIGS. 4A and 4E, in this embodiment, the plate body 310 is not in contact with the contact portion 2312 of each of the terminals 231.

As shown in FIGS. 1 to 4A and FIG. 4E, in this embodiment, the tongue plate 120 further comprises a protruding platform 123. The protruding platform 123 is protruding from the first surface 121 of the tongue plate 120, and the contact portions 2312 of each of the terminals 231 is extending to the protruding platform 123 and exposed form the protruding platform 123.

As above, with the experiment verifications, the conductive shielding member of the electrical connecting device according to one or some embodiments of the instant disclosure just has to be configured near the ground terminals of the terminal sets and does not have to be in contact with the ground terminals for achieving a proper noise shielding performance. Hence, interference during transmission can be effectively prevented, thereby ensuring the quality in signal transmission. Moreover, in some embodiments, the conductive shielding member is a one-piece structure made of conductive plastics, and the insulated body completely encloses the conductive shielding member. During the manufacturing process of the conductive shielding member, the conductive shielding member may be formed or disposed in the insulated body in advance, and then the terminals of the terminal sets are configured to predefined positions of the insulated body. Under such condition, additional steps for exposing the conductive shielding member to contact the ground terminals of the terminal sets are not required. Accordingly, the manufacturing difficulty for the electrical connecting device can be reduced, thereby lowering the manufacturing costs.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connecting device comprising:

an insulated body comprising a base and a tongue plate connected to the base;

a first terminal set comprising a plurality of first signal terminals and a plurality of first ground terminals, wherein each of the first signal terminals and each of the first ground terminals respectively comprise a fixed portion and a contact portion, the fixed portion of each of the first signal terminals and the fixed portion of each of the first ground terminals are in the base, and the contact portion of each of the first signal terminals and the contact portion of each of the first ground terminals are extending to the tongue plate and exposed from the tongue plate; and a conductive shielding member in the insulated body, wherein the conductive shielding member is near but not in contact with the first terminal set;

wherein the conductive shielding member comprises a plate body and a plurality of ribs, the plate body is in the tongue plate, the ribs are protruding from the plate body; the ribs correspond to the first ground terminals, respectively, and the ribs are near but not in contact with the first ground terminals;

wherein a distance between each of the ribs and the corresponding first ground terminal is in a range between 0.03 mm to 0.3 mm.

2. The electrical connecting device according to claim 1, wherein the conductive shielding member and the first terminal set is spaced by the insulated body.

3. The electrical connecting device according to claim 2, wherein the insulated body encloses the conductive shielding member, and the conductive shielding member is not exposed from the insulated body.

4. The electrical connecting device according to claim 1, wherein the conductive shielding member is made of conductive plastics, and the conductive shielding member is a one-piece structure.

5. The electrical connecting device according to claim 1, further comprising a second terminal set, wherein the second terminal set comprises a plurality of second signal terminals and a plurality of second ground terminals; each of the second signal terminals and each of the second ground terminals respectively comprise a fixed portion and a contact portion, the fixed portion of each of the second signal terminals and the fixed portion of each of the second ground terminals are in the base, and the contact portion of each of the second signal terminals and the contact portion of each of the second ground terminals are extending to the tongue plate and exposed from the tongue plate; wherein the contact portion of each of the first ground terminals and the contact portion of each of the second ground terminals are at two opposite surfaces of the tongue plate, the conductive shielding member is between the contact portion of each of the first ground terminals and the contact portion of each of the second ground terminals, and the conductive shielding member is near but not in contact with the second terminal set.

6. The electrical connecting device according to claim 5, wherein the shielding member comprises a plate body and a plurality of ribs, the plate body is in the tongue plate, the ribs are protruding from the plate body; the ribs correspond to the first ground terminals or the second ground terminals, respectively, and the ribs are near but not in contact with the first ground terminals and the second ground terminals.

7. The electrical connecting device according to claim 6, wherein a distance between each of the ribs and the corresponding first ground terminal or a distance between each of the ribs and the corresponding second ground terminal is in a range between 0.03 mm to 0.3 mm.

8. The electrical connecting device according to claim 6, further comprising a third terminal set and a fourth terminal set, wherein the third terminal set comprises a plurality of terminals and the fourth terminal set comprises a plurality of terminals; the first terminal set, the third terminal set, and the fourth terminal set are at a same surface of the tongue plate, the conductive shielding member is between the first terminal set, the second terminal set, the third terminal set, and the fourth terminal set, the conductive shielding member is devoid of ribs near the terminals of the third terminal set and the terminals of the fourth terminal set.

9. The electrical connecting device according to claim 8, wherein a protruding platform is protruding from the tongue plate, and a contact portion of each of the terminals of the third terminal set is extending to the protruding platform and exposed from the protruding platform.

* * * * *